United States Patent [19]

Hawryluk et al.

[11] 4,437,884

[45] Mar. 20, 1984

[54] ORE ROASTING WITH RECYCLE OF GASES

[75] Inventors: Raymond Hawryluk, Upper St. Clair; Clyde R. Johnson, Claysville, both of Pa.; N. Henri Masarky, Tenafly, N.J.

[73] Assignee: Union Oil Company of California, Los Angeles, Calif.

[21] Appl. No.: 412,779

[22] Filed: Aug. 30, 1982

Related U.S. Application Data

[63] Continuation of Ser. No. 205,788, Nov. 10, 1980, abandoned.

[51] Int. Cl.[3] ..... C22B 1/02; C01G 39/00

[52] U.S. Cl. ..... 75/7; 423/53; 423/606

[58] Field of Search ..... 75/7, 8, 9; 423/154, 423/542, 89, 110, 53, 606, 619, 622

[56] References Cited

U.S. PATENT DOCUMENTS

| | | | |
|---|---|---|---|
| 1,884,348 | 10/1932 | Stimmel et al. | 75/7 |
| 2,046,753 | 7/1936 | Stout et al. | 423/542 X |
| 2,843,430 | 5/1958 | Johnson | 75/7 X |
| 3,871,867 | 3/1975 | Last et al. | 75/7 X |
| 4,034,969 | 7/1977 | Grimes | 266/82 |
| 4,221,588 | 9/1980 | Grimes | 75/7 |

FOREIGN PATENT DOCUMENTS 1366712 9/1974 United Kingdom .

OTHER PUBLICATIONS

Paleshnikov et al., Chemical Abstracts, 80:72980u, (1974).

*Primary Examiner*—Earl C. Thomas

*Attorney, Agent, or Firm*—Dean Sandford; Gregory F. Wirzbicki; Robert A. Franks

[57] ABSTRACT

Metal sulfide ores which contain organic matter are oxidized by roasting in a multiple hearth furnace, wherein at least a portion of gases formed during the oxidation is recycled from a higher-temperature, upper portion of the furnace to a lower-temperature, lower portion of the furnace. The control of air pollution from the furnace is facilitated by making some volatile organics, otherwise vented from the furnace, available for combustion, and by increasing the sulfur oxide concentration in the furnace gases.

13 Claims, 2 Drawing Figures

ORE ROASTING WITH RECYCLE OF GASES

This application is a continuation of application Ser. No. 205,788, filed Nov. 10, 1980, and now abandoned.

BACKGROUND OF THE INVENTION

This invention relates to a method for reducing emissions of organic pollutants while roasting metal-containing ores and concentrates, particularly metal sulfides, in the presence of air.

The oxidation roasting of metal sulfide ores and concentrates, to remove sulfur and render the metal more amenable to further chemical or metallurgical purification and conversion, has been widely used for many years. Such a process can be efficiently conducted in multiple-hearth furnaces, of which several variations are known, including those referred to as Herreshoff, Nichols, Nichols-Herreshoff, Wedge, Skinner, Pacific and others.

Chemical reactions occurring within the furnace are primarily those of oxidation, having the net effect of converting the metal sulfide into metal oxides and gaseous oxides of sulfur. Such conversion is accompanied by the evolution of considerable heat energy, which must be dissipated rather quickly to avoid prolonged exposure of the formed metal oxides at such temperatures as could cause their vaporization, melting or fusion with other materials in the furnace. In addition, heat removal is necessary to protect the interior components of the furnace, since exposure to higher temperatures can markedly reduce the service life of many commonly used construction materials.

In the past, this heat dissipation has been effected by drawing air through the furnace, in amounts far exceeding that necessary to supply the oxygen required by the stoichiometry of the desired combustion reactions. Furnace temperature levels are thus controlled by increasing or decreasing the quantity of cooling air which flows through the furnace.

Unfortunately, however, the introduction of large excesses of air has resulted in dilution of the sulfur oxide concentration in waste gases exiting the furnace to a level considerably below that which would be obtained with an air flow close to the stoichiometric air required for combustion. Since the release to the atmosphere of large quantities of sulfur oxides has become environmentally unacceptable, it has been necessary to provide sulfur removal treatment for large volumes of waste gases which contain low concentrations of sulfur oxides. Such treatment is technologically more difficult and requires much greater capital expenditures than would be needed for smaller volumes of gases.

In addition to the sulfur oxide pollution problems, quantities of organic vapors must be removed from gases exiting the furnace. These organics are primarily residues from flotation concentration techniques performed on the sulfide ores prior to the roasting process, and are volatilized during heating to the uppermost hearths of a furnace, prior to initiation of the oxidation reactions. The organic vapors are diluted in the same manner as are the sulfur oxides, and are also very difficult to remove when large volumes of cooling air are used in a furnace.

A further disadvantage resulting from the necessity for excess air is the increased instability in furnace operating conditions. Changes in ambient air temperature (e.g., from daytime to evening, or summer to winter), humidity, etc. can cause significant alterations in temperature levels within the roaster, which are made more severe with increased air volumes. Because of this, the level of operator attention and control adjustments needed is significantly increased.

One technique for decreasing the volume of excess air required is that of Grimes in U.S. Pat. No. 4,034,969, wherein a system for spraying cooling water onto individual hearths is described. Advantages claimed for this system are, inter alia, closer control of temperature on each hearth and facilitation of air pollution control.

Fitton, in British Pat. No. 1,366,712, has described a recycle system for waste gases in a furnace for roasting pelletized lead or zinc sulfides, in which a reduction in the amount of supplied air is contemplated. The resulting increase in sulfur dioxide concentration of the recycled gases is claimed to control the rate at which the feed pellets oxidize.

An article in the Bulgarian language by Paleshnikov et al., abstracted in *Chemical Abstracts*, Vol. 80, 7298u (1974), reports an increased sulfur dioxide content from about 2 percent to about 5.5 percent, due to partial recirculation of gases during the roasting of lead ore concentrates. However, the type of roaster used is not given in the abstract.

Accordingly, it is an object of this invention to provide a method which will decrease the volume of supplied air in a multiple-hearth furnace for roasting metal sulfides, thereby increasing sulfur oxide concentration and reducing the capital costs and operating expenses of air pollution abatement.

It is a further object to capture a significant portion of the organic vapors in an ore roasting process, and utilize those vapors to supply some part of the fuel requirements of the furnace.

A still further object is to stabilize furnace operating conditions through the reduction in volume of supplied air.

Another object is to lessen the heat losses in a multiple-hearth furnace by recycling hot exhaust gases back into cooler portions of the furnace.

These, and other objects, will more clearly appear from consideration of the following disclosure and accompanying drawings.

SUMMARY OF THE INVENTION

The process of this invention provides a means for reducing the cost of air pollution control in the operation of multiple-hearth furnaces which are used for the oxidative roasting of metal sulfide ores and concentrates. These, and other benefits, are obtained by employing a gas recycling technique in which a portion of the higher-temperature furnace gases is removed and re-introduced to the furnace in a lower temperature region.

Among the benefits from recycling gases is a reduction in the required volume of supplied cooling air for the furnace. As a result, the concentration of pollutants in gases exiting the furnace, notably sulfur oxides, is markedly increased, thereby reducing the volume of waste gases required to be treated for removal of pollutants.

In addition, organic matter in the fed ores and concentrates is volatilized and introduced into a region of the furnace in which a larger portion will be burned, decreasing the amount of organic pollution escaping the furnace.

DETAILED DESCRIPTION OF THE INVENTION

This invention is applicable to the oxidation roasting treatment of metal sulfide ores and concentrates including, without limitation, the sulfides of molybdenum, lead, zinc, iron, copper, nickel and other metals commonly recovered by such techniques. The concentrates to be treated are normally prepared by the flotation concentration of ores, and therefore have particle sizes which have been reduced to less than about 60 mesh; in many instances less than about 100 mesh.

Figure 1:
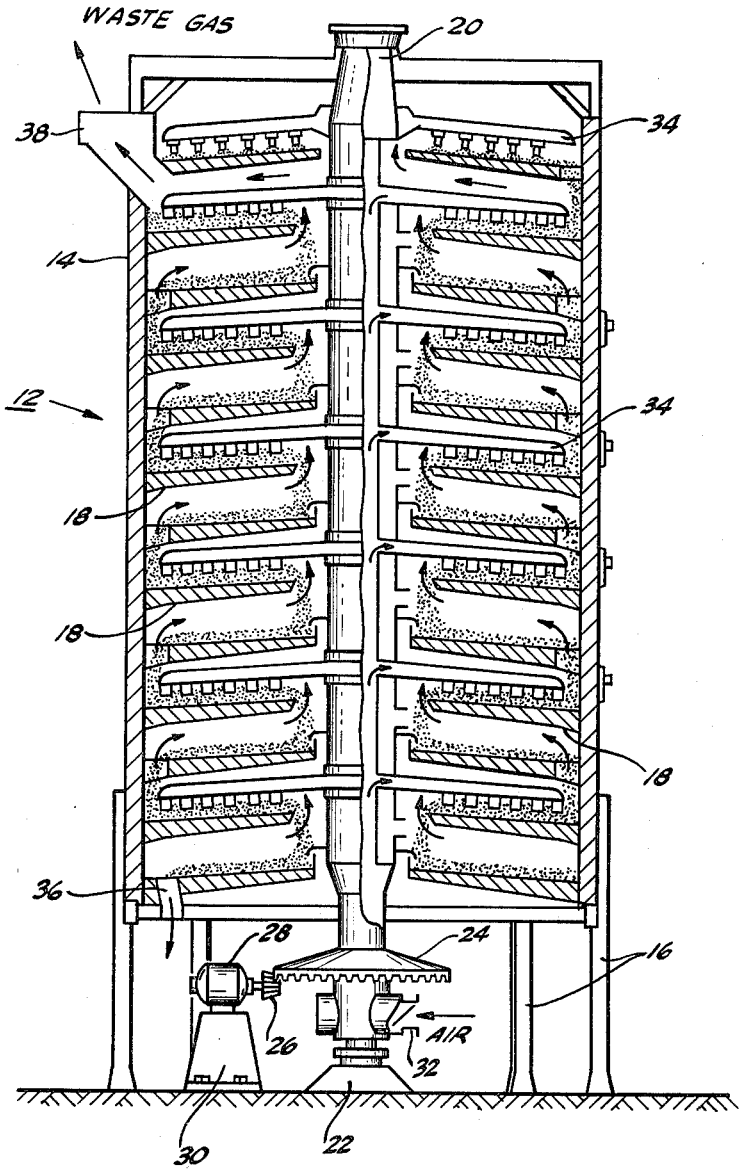
FIG. 1 is a diagram showing the arrangement of components in a multiple-hearth furnace of the Nichols-Herreshoff design.

The process of this invention is conducted in a multiple-hearth furnace, one type of which is depicted in FIG. 1. Referring to the Figure, the furnace 12 comprises an outer shell 14 of heat resistant and insulating material, mounted on supports 16, and having several hearths 18 arranged in a vertical stack. Each hearth is provided with a centrally located axial opening through which a hollow central shaft 20 passes. The shaft is supported on a base 22, upon which it is free to rotate, and is provided with a gear 24, coupled to a pinion 26 and motor 28 which provides a rotational force. The motor is mounted upon a pillar 30. The hollow shaft is provided with an opening 32, through which air is introduced. Air flows into the hollow shaft and passes through hollow rabble arms 34, which project from the shaft.

Ore is fed to the uppermost hearth and is subjected to movement on the hearth, caused by vane-like projections, usually called "rabbles", extending from the lower surface of each rabble arm. These projections function to mix and turn the ore particles as the central shaft and rabble arms rotate and, depending upon the angle of the projections with respect to the rabble arm, to direct the particles either inward toward the center of the hearth or outward toward the periphery. Particles which are directed toward the center of a hearth fall through the axial opening to the hearth below, where they are then directed toward the periphery, and fall through an opening to the hearth below. Thus, ore moves inwardly and outwardly on succeeding hearths, and falls from the top toward the bottom hearth.

Burners (not shown) for natural gas, fuel oil, etc. can normally be mounted, as desired, at any hearth to heat the furnace. The air which is introduced into the central shaft is used to cool the shaft and rabble arms, ordinarily removing about 20 percent of the heat produced by combustion of the sulfide ore. Circulation of gases within the furnace is shown by the arrows, with gases exiting the furnace at a flue 38.

As ore particles move downward through the furnace, they are converted from metal sulfides to metal oxides, by combustion with the circulating air. The converted calcine is discharged at an outlet 36, and formed oxides of sulfur flow upward with the circulating gases.

Although not shown in FIG. 1, some or all of the hearths can be equipped with air inlets or outlet flues, or both, to establish cross flows of air which promote desired combustion patterns and cooling functions.

It should be noted that many variations in equipment exist for performing the ore roasting process. For example, rotational force to a central shaft can be supplied by a hydraulic drive mechanism, rather than by a motor, without affecting the instant invention.

Typically, the majority of ore conversion occurs in the uppermost half of the furnace. Since the combustion reactions are exothermic, the upper half of the furnace operates at a temperature which is considerably higher than that at lower regions of the furnace. The top hearth is usually the site of drying and initial heating of the incoming ore particles, and almost all of the combustion takes place upon the next three or four lower hearths, in successively decreasing proportions.

Due to the localized nature of the exothermic reactions within the furnace, therefore, the primary need for cooling is in this upper portion. As noted previously, the majority of cooling is normally accomplished by drawing large volumes of air through the furnace, the air entering the furnace by means of inlet openings located at selected hearths and flowing toward the exhaust flue primarily due to the presence of exhaust fans (not shown) external to the furnace, which aid in moving waste gases to pollution abatement equipment.

Figure 2:
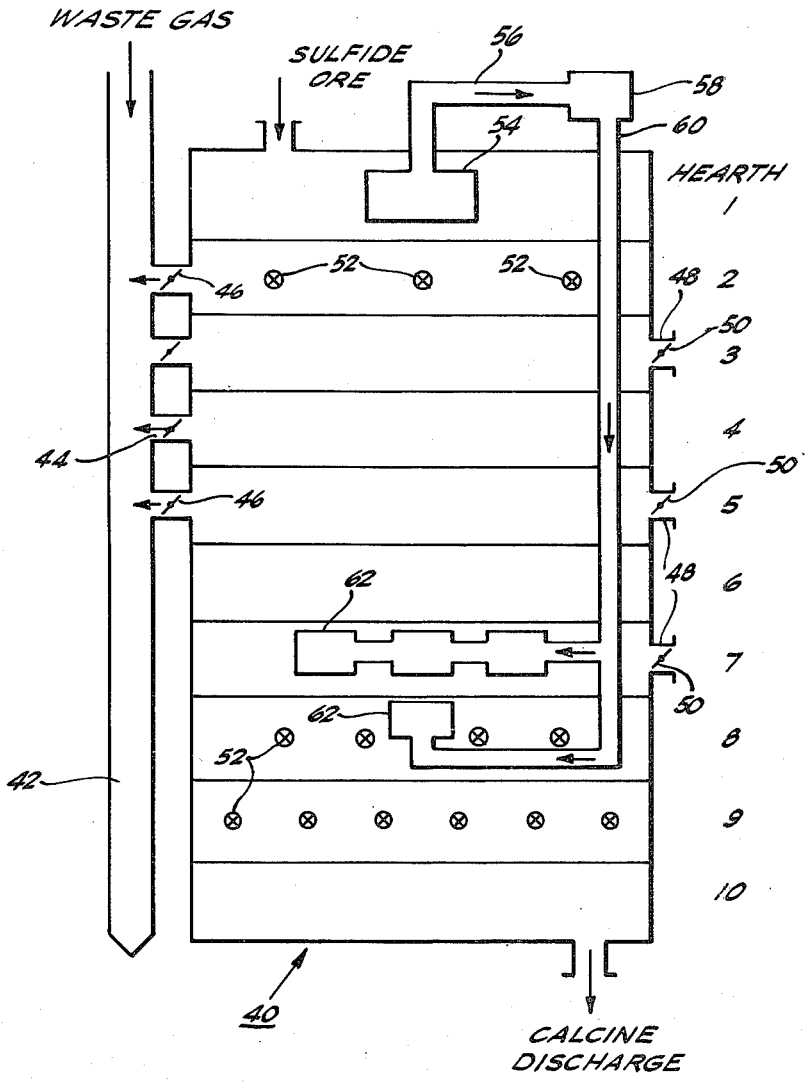
FIG. 2 is a schematic diagram showing the addition of a gas recycle system to a multiple-hearth furnace.

The operation of an improved roasting process, including a representative embodiment of the present invention, may be described with reference to FIG. 2. In this drawing, a furnace 40, shown here for illustrative purposes as having ten hearths, numbered from top to bottom as 1 through 10, is provided with an exhaust flue 42, attached by means of several gas outlet ports 44. Each outlet port is equipped with a means for regulating or stopping gas flow 46, which can be a simple damper. The hearths are also equipped with air inlet ports 48, each port having a flow regulating means 50, such as a damper. Burners 52 are mounted on selected hearths, as heat sources.

A gas recycle system is shown as comprising a recirculating gas inlet 54, connected by a duct 56 to a blower 58. An additional duct 60 leads from the blower to recirculating gas outlets 62. The direction of gas flow in the system is as depicted by the arrows. Although not shown, each gas outlet is provided with a means of controlling or stopping gas flow.

It should be noted that, although a gas inlet is shown as being at hearth 1 and gas outlets are shown at hearths 7 and 8, different furnaces will have varying optimum operating parameters, resulting in considerable variation of configurations which embody the principles of this invention. The various features of the drawing are intended to be illustrative of only one of the several possible embodiments of the invention, and it is not intended that the scope of the invention should be limited thereby.

In addition to the recycle of hot gases, as described above, it is possible to obtain some of the same benefits by recycling gases from the exhaust flue.

Although the described recycle system can be advantageously employed for roasting any metal sulfide, as noted previously, its use will be most beneficial, from the standpoint of enhancing sulfur oxide content of waste gases, for these metal sulfides having a higher heat of combustion. This is more apparent from consideration of the thermodynamics of ore roasting.

In addition to the differences in roasting temperatures which would be chosen for various metal sulfides, considerable divergence in their respective heats of combustion is noted. Using standard free energies of formation, the following can be calculated:

| | |
|---|---|
| $MoS_2 + 3.5\ O_2 \rightarrow MoO_3 + 2\ SO_2$ | $\Delta H^\circ = -187.5$ Kcal/mole |
| $ZnS + 1.5\ O_2 \rightarrow ZnO + SO_2$ | $\Delta H^\circ = -110$ Kcal/mole |
| $PbS + 1.5\ O_2 \rightarrow PbO + SO_2$ | $\Delta H^\circ = -91.5$ Kcal/mole |

As can be seen, the oxidation of molybdenum sulfide is considerably more exothermic than that of zinc or lead sulfides. For this reason, much more cooling air must be used in a molybdenum roaster to produce a given amount of roasted product, resulting in a greater dilution of sulfur oxides.

Furthermore, the amount of gas which can be recycled in a lead or zinc roaster is more limited, since a relatively greater function of the oxygen in the supplied air is consumed by the combustion reaction. In a molybdenum roaster, however, a very large volume of cooling air is used, and the recycled air is not depleted of oxygen to such an extent as to significantly affect the combustion reaction.

Among the benefits obtained from the addition of a recycle system to a roaster for molybdenum sulfide concentrates is an increase in the concentration of sulfur oxides in the waste gases from the furnace. Without recycle, the sulfur oxides comprise only about 1 volume percent, or less, of the waste gas. Such low concentrations in a large volume of gases greatly increase the cost and complexity of pollution control equipment. For example, one method for pollution control is conversion of the sulfur oxides to sulfuric acid, which can be marketed as a useful commodity. A sulfuric acid recovery plant will not operate effectively, however, if the feed gases contain only 1 volume percent of sulfur oxides, so it is frequently necessary to burn sulfur and add the resulting sulfur oxides to the furnace waste gases. With a gas recycle system, the waste gases can be made to contain as much as about 3 volume percent of sulfur oxides, thereby significantly facilitating a more economical recovery of these pollutants.

In addition, the hydrocarbon content of the waste gases is diminished by the use of a recycle system. Ore concentrates, which are used as feed material for roasting furnaces, can contain as much as 8% by weight or more hydrocarbons. This organic matter comprises oils and surfactants which are used to condition the ore particles during flotation concentration procedures and which are not removed during subsequent drying of the concentrates. In the roasting furnace, the organic matter typically volatilizes during the heating and drying which occurs on the upper hearths, and passes from the furnace with the waste gases. However, the recycle system described herein provides a means for removing volatile hydrocarbons and introducing them at a lower point in the furnace where they can be burned. As a result, the amount of hydrocarbon pollutants in the waste gas is reduced. Furthermore, heat values are recovered from the hydrocarbons, favorably affecting the economics of furnace operation.

Furnace operating conditions can be controlled with a greater precision, because of the addition of a gas recycle system. Even though the recycle does not significantly alter the total volume of gases necessary for cooling and combustion, supplying a portion of the requirement with recycle gases decreases the usage of fresh air. Since recycled gases maintain a more constant temperature and humidity than fresh air, changes in outside temperature, season and other climatic factors have a lesser effect upon the furnace operation.

The invention is further illustrated by the following example which is illustrative of various aspects of the invention, and is not intended as limiting the scope of the invention as defined by the appended claims.

EXAMPLE

A furnace of the Nichols-Herreshoff design, having ten hearths, is fed with molybdenum sulfide concentrates of a small particle size (less than about 10 percent by weight greater than 100 mesh, less than about 5 percent by weight smaller than 325 mesh) which contain approximately 3 percent by weight of organic materials. The furnace is adapted to operation both with and without recycling of the contained gases. Referring to FIG. 2 normal operation without recycle is obtained by opening the air inlets on hearths 3, 5 and 7, as well as opening outlet ports on hearths 2,3,4 and 5, while closing off all recirculating gas outlets. When recycle operation is desired, the air inlet at hearth 7 is closed and the outlet port on hearth 2 is closed, and recycle established by starting the blower and opening the desired recirculating gas outlets at hearths 7 and 8.

Using a feed rate to the furnace of 1,800 pounds per hour, the following results are obtained during several hours of operation:

| Condition | Furnace Waste Gases | | |
|---|---|---|---|
| | Flow, SCFM | | Temp, °F. |
| No recycle | 7,800 | | 750 |
| With recycle | 5,500 | | 1,000 |
| | High | Low | Average |
| | Waste Gas $SO_2$, Volume Percent | | |
| No recycle | 1.2 | 0.7 | 1.0 |
| With recycle | 2.5 | 1.6 | 2.2 |
| | Waste Gas hydrocarbons, volume percent | | |
| No recycle | 0.8 | 0.6 | 0.7 |
| With recycle | 0.5 | 0.2 | 0.4 |

Various embodiments and modifications of this invention have been described in the foregoing description and example, and further modifications will be apparent to those skilled in the art. Such modifications are included within the scope of the invention as defined by the following claims.

We claim:

1. A process for reducing organic matter emissions during the oxidative roasting of metal sulfides in a furnace which is heated by fuel burners, and which has a plurality of hearths in a vertical configuration, wherein at least a portion of higher-temperature gases formed during the oxidation is recycled to a lower-temperature, lower portion of the furnace.

2. A process according to claim 1 in which the metal sulfides are the products of the flotation concentration of ores.

3. A process according to claim 1 in which a metal sulfide comprises molybdenum sulfide.

4. A process according to claim 1 in which the organic matter comprises residues from flotation concentration procedures.

5. A process according to claim 1 in which the gases are recycled from the uppermost hearth of the furnace.

6. A process according to claim 1 in which at least a portion of the organic matter is recycled and burned in the furnace.

7. A process for the oxidative roasting of ore concentrates comprising molybdenum sulfide in a furnace which is heated by fuel burners, and which has a plurality of hearths in a vertical configuration, wherein at least a portion of higher-temperature gases formed during the oxidation is recycled to a lower-temperature, lower portion of the furnace.

8. A process according to claim 7 in which the ore concentrates are products of flotation concentration procedures.

9. A process according to claim 8 in which organic residues from the flotation concentration are present in the ore concentrates, and at least a portion of said organic residues are recycled and burned in the furnace.

10. A process according to claim 7 in which the gases are recycled from the uppermost hearth of the furnace.

11. A process for the oxidative roasting of molybdenum sulfide ore flotation concentrates containing organic matter in a furnace which is heated by fuel burners, and which has a plurality of hearths in a vertical configuration, wherein at least a portion of higher-temperature gases formed during the oxidation is recycled to a lower-temperature, lower portion of the furnace, at least a portion of said organic matter being recycled and burned in the furnace.

12. A process according to claim 11 in which the gases are recycled from the uppermost hearth of the furnace.

13. A process according to claim 11 in which the concentrates have a particle size of less than about 60 mesh.

* * * * *